US007677574B1

(12) United States Patent
Butkiewicz et al.

(10) Patent No.: US 7,677,574 B1
(45) Date of Patent: Mar. 16, 2010

(54) RANDOM CHANCE DEVICE FOR USE IN A GAME WHERE CARDS ARE DRAWN DURING PLAY

(76) Inventors: Robert A. Butkiewicz, 4201 Church Rd., #254, Mount Laurel, NJ (US) 08054; James P. Carty, 4201 Church Rd., #254, Mount Laurel, NJ (US) 08054

( * ) Notice: Subject to any disclaimer, the term of this patent is extended or adjusted under 35 U.S.C. 154(b) by 152 days.

(21) Appl. No.: 11/705,298

(22) Filed: Feb. 11, 2007

Related U.S. Application Data

(60) Provisional application No. 60/772,538, filed on Feb. 13, 2006.

(51) Int. Cl.
*A63F 1/00* (2006.01)

(52) U.S. Cl. ..... 273/292; 273/142 J

(58) Field of Classification Search ..... 273/280, 273/287, 139, 292, 142 R, 142 A–142 D, 273/142 J, 142 JA–142 JD
See application file for complete search history.

(56) References Cited

U.S. PATENT DOCUMENTS 3,143,347 A * 8/1964 Ruderian ..... 273/147
4,061,336 A * 12/1977 Lincoln ..... 273/254
5,388,835 A * 2/1995 Albright ..... 273/249
6,834,856 B2 * 12/2004 Wilson ..... 273/246
7,172,505 B2 * 2/2007 Vancura ..... 463/16
2002/0135126 A1 * 9/2002 Marcus ..... 273/242
2002/0190466 A1 * 12/2002 Bryan ..... 273/254
2003/0085520 A1 * 5/2003 Bedford et al. ..... 273/255
2004/0195768 A1 * 10/2004 Poulos ..... 273/244
2005/0187002 A1 * 8/2005 Falciglia, Sr. ..... 463/13
2007/0108703 A1 * 5/2007 Ritter ..... 273/292
2008/0207299 A1 * 8/2008 Whitcher ..... 463/17

OTHER PUBLICATIONS

Double Action, Double Trouble, Spinning Fun, Mattel Inc. New Product Description, Feb. 2005.*

* cited by examiner

*Primary Examiner*—William M Pierce
(74) *Attorney, Agent, or Firm*—LaMorte & Associates P.C.

(57) ABSTRACT

A game assembly and method of adding additional randomness to a game that uses a deck of cards during play. The deck of cards contains event cards that cause players to perform certain actions if drawn during the play of the game. A random selection device is provided. The random selection device utilizes indicia that correspond to the event cards and/or some new event activity. The random selection device embodies a means to randomly select a single indicia from the plurality of indicia being used. At least one card is added to the deck of cards that indicates that the selection device is to be used. Accordingly, when the card is drawn, the random selection device is utilized. The game is played as if the card indicated by the random selection device had been drawn from the deck of cards.

17 Claims, 4 Drawing Sheets

RANDOM CHANCE DEVICE FOR USE IN A GAME WHERE CARDS ARE DRAWN DURING PLAY

RELATED APPLICATIONS

This application claims priority of Provisional Patent Application No. 60/772,538, entitled Random Chance Device For Use In A Game Where Cards Are Drawn During Play, filed Feb. 13, 2006.

BACKGROUND OF THE INVENTION

1. Field of the Invention

In general, the present invention relates to chance wheels and other such random chance devices that are used during the play of a game. More particularly, the present invention relates to random chance devices that are used in conjunction with a deck of cards to add another layer of randomness to a card selection process.

2. Prior Art Description

There are many types of games that use cards. Some games, such as UNO®, use nothing but cards. Some games, such as Monopoly®, use chance cards as one part of a larger game assembly.

Cards are typically used as random chance devices within the play of a game. Cards can be easily shuffled. Accordingly, a person playing a game cannot predict what cards will be drawn when playing the game. As a consequence, the game is never the same each time it is played.

Although the drawing of a card during a game does add chance to a game, the amount of chance is directly proportional to the number of different cards present in the card deck. If a deck of cards only has four types of cards, the odds of selecting a particular card is 1:4, or 25%.

Games are typically made more interesting by adding more chance to the game. However, in many games, such as UNO®, the number and types of cards embody the very nature of the game. It is therefore not possible to change the number and types of cards in the game without fundamentally changing the game.

The present invention is directed toward a random chance device that adds a higher level of chance to a game that would otherwise rely upon cards for chance. The present invention adds chance without significantly altering the deck of cards being used or the rules of the game being played. The details of the present invention are described and claimed below.

SUMMARY OF THE INVENTION

The present invention is a game assembly and method of adding additional randomness to a game that uses a deck of cards during play.

A deck of cards is provided for use in playing a game. The deck of cards contains event cards that cause players to perform certain actions if drawn during the play of the game. A random selection device is provided. The random selection device utilizes indicia that correspond to the event cards in the deck of cards and/or new event activities. The random selection device, therefore, embodies a means to randomly select a single indicia, from the large grouping of indicia, that corresponds to one of the events cards in the deck of cards and/or a new events activity.

At least one card in the deck of cards indicates that the selection device is to be used. The card can be a new card that is added to the deck or some indicia that is added to an existing card. Accordingly, when the card is drawn, the random selection device is utilized. The random selection device randomly denotes an indicia corresponding to one of the other cards in the deck and/or some new event activity. The game is played as if the event activity indicated by the random selection device had been drawn from the deck of cards. In this manner, additional randomness and chance can be added to a game without having to materially alter the cards used in the game or the rules of play.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

The present invention can be embodied in many ways. A few exemplary embodiments are illustrated and described below. Although the present invention can be incorporated into many games that use cards, the present invention is particularly well suited for games that are solely based upon cards, such as UNO®. Accordingly, the present invention will be described as being applied to the UNO® game in order to set forth the best mode contemplated for the invention. It will be understood that such embodiments are merely exemplary and should not be considered a limitation on the claims.

In the game of UNO®, players draw a hand of cards. The players then try to rid themselves of the cards. The player who first gets rid of his/her cards wins the game. In the deck of UNO® cards, there are general play cards of various colors and numbers. There are also event cards. The event cards cause an event to occur. The event may be to select multiple cards, skip a turn, reverse the direction of play, etc. The events that occur are not of importance to the present invention. The event cards are mixed with the general play cards to make the game less predictable, less based on skill, more based on chance, and thus more fun to play.

Figure 1:
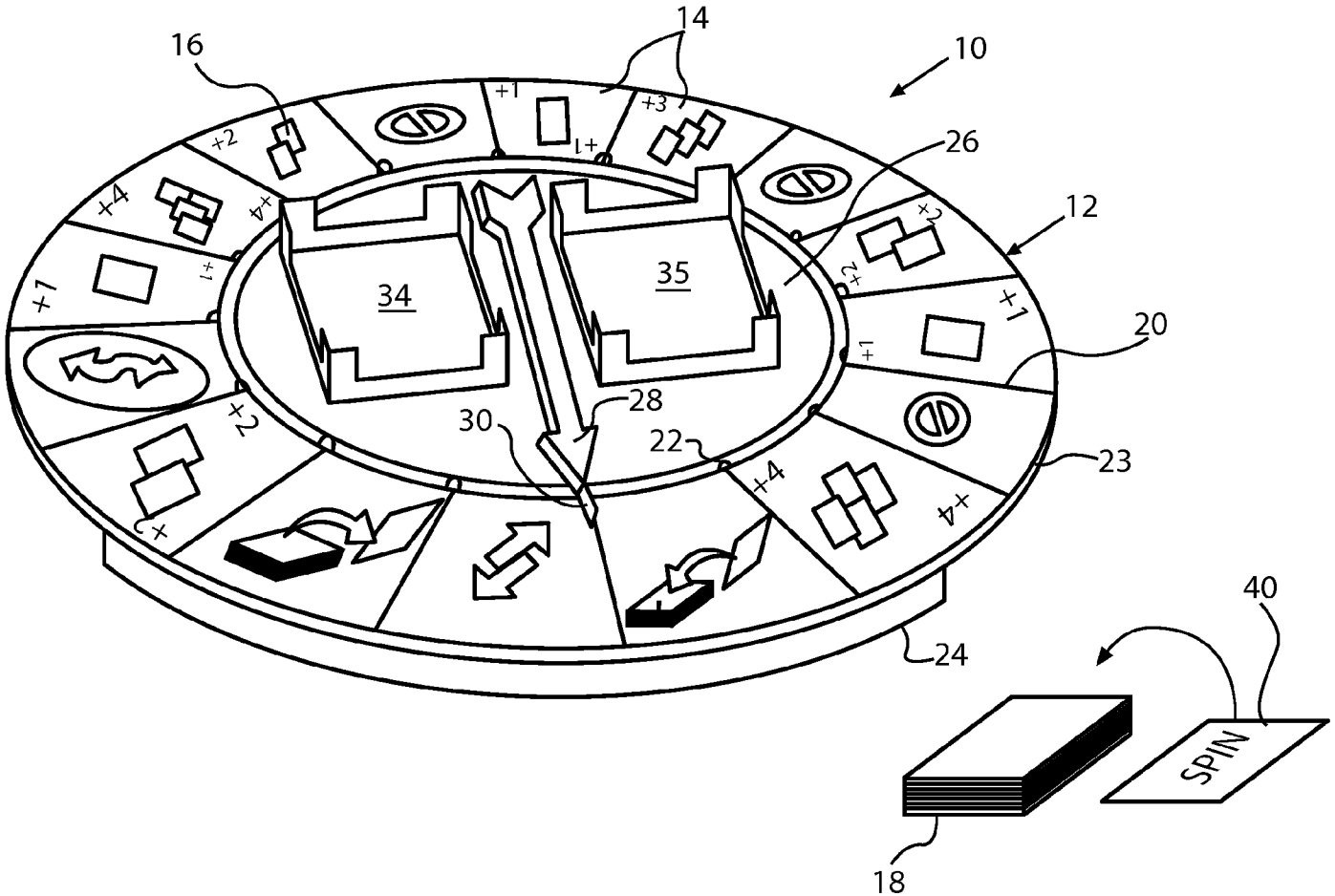
FIG. 1 is a perspective view of a game assembly containing a first exemplary embodiment of a random chance device.

Referring to FIG. 1, an exemplary embodiment of the present invention spinning wheel random chance device 10 is shown. The spinning wheel random chance device 10 has a spinning game board 12. On the spinning game board 12 are spaces 14 with indicia 16. The indicia 16 depict either the various event cards that are contained within the deck of cards 18 or some new event activity not originally contained in the game. The number of spaces 14 on the spinning game board 12 is preferably at least as large as the number of event cards used in the deck of cards 18 used to play the game. A borderline 20 separates each of the spaces 14 on the spinning game board 12. A peg 22 or similar protrusion is present at the top of each borderline 20. The pegs 22 extend vertically above the spinning game board 12.

The spinning game board 12 is comprised of a wheel 23 that rests upon a freestanding base platform 24. The base platform 24 is stationary and rests upon any flat surface. The wheel 23 is free to rotate upon the base platform 24. Accordingly, it will be understood that when the wheel 23 is pushed, it will rotate upon the base platform 24. The wheel 23, therefore, spins in a horizontal plane around a vertical axis.

The wheel 23 is annular in shape. An open space, therefore, exists in the center of the wheel 23 where a top section 26 of the base platform 24 is exposed. At least one indicator arrow 28 is present on the exposed top section 26 of the base platform 24. A flap 30 is provided at the tip of the indicator arrow 28. The flap 30 extends over the wheel 23 and contacts the pegs 22 on the wheel 23 as the wheel 23 rotates. Consequently, the flap 30 provides resistance to the rotation of the wheel 23 and will eventually cause the wheel 23 to stop rotating when the flap 30 and indicator arrow 28 are pointing at a space 14 on the wheel 23 in between two adjacent pegs 22. Furthermore, as the wheel 23 rotates, the flap 30 provides a clicking noise as it slaps past the various pegs 22.

It will be understood that the flap 30 can be positioned on the outside of the wheel 23 instead of the inside. In such an alternate embodiment, the pegs 22 would also be positioned toward the outside of the wheel 23 so as to interact with the flap 30.

At least one deck receptacle is also present on the exposed top section 26 of the base platform 24. The number of deck receptacles depends upon the game being played. In the exemplary game of UNO®, two deck receptacles 34, 35 would be used. Each deck receptacle 34, 35 is configured to hold the deck of playing cards 18 used in the game. One deck receptacle 34 holds unused playing cards. The other deck receptacle 35 holds used playing cards that have been discarded.

To utilize the present invention random selection device 10, at least one new type of card is provided. The new type of card is a spin card 40. The spin card 40 can be a new independent card or can be some existing card upon which some new spin indicia has been added. It will therefore be understood that the spin card 40 may also be some existing event card that informs a player to take cards, loose a turn, etc. The spin card 40, or cards, is shuffled into the deck of playing cards 18. The deck of playing cards 18 is then placed into the deck receptacle 34 for unused cards. The card game is played using its existing rules. Players draw cards, as needed, from the playing deck of playing cards 18. When a player selects a spin card 40 from the deck of playing cards 18, that player spins the wheel 23.

Once spun, the wheel 23 turns relative to the arrow indicator 28. After the wheel 23 stops, the indicator arrow 28 will be randomly pointed at one of the spaces 14. As mentioned earlier, the spaces 14 are marked to correspond to the event cards that are in the deck of playing cards 18 or some new event activity. The player must then comply with the event card shown on the wheel 23 as though that were an event card that was selected from the deck of playing cards 18 during play.

It will therefore be understood, that when a player selects a spin card 40 during play, it has the same effect as drawing an event card from the deck of playing cards 18. However, due to the nature of the spinning wheel random chance device 10, the selection of the event card is random. This second layer of randomness does not change the cards used during play, other than to add spin cards 40 to the playing card deck 18. Furthermore, the game is still played with its original rules in all respects aside from the use of the spinning wheel random chance device 10.

Figure 2:
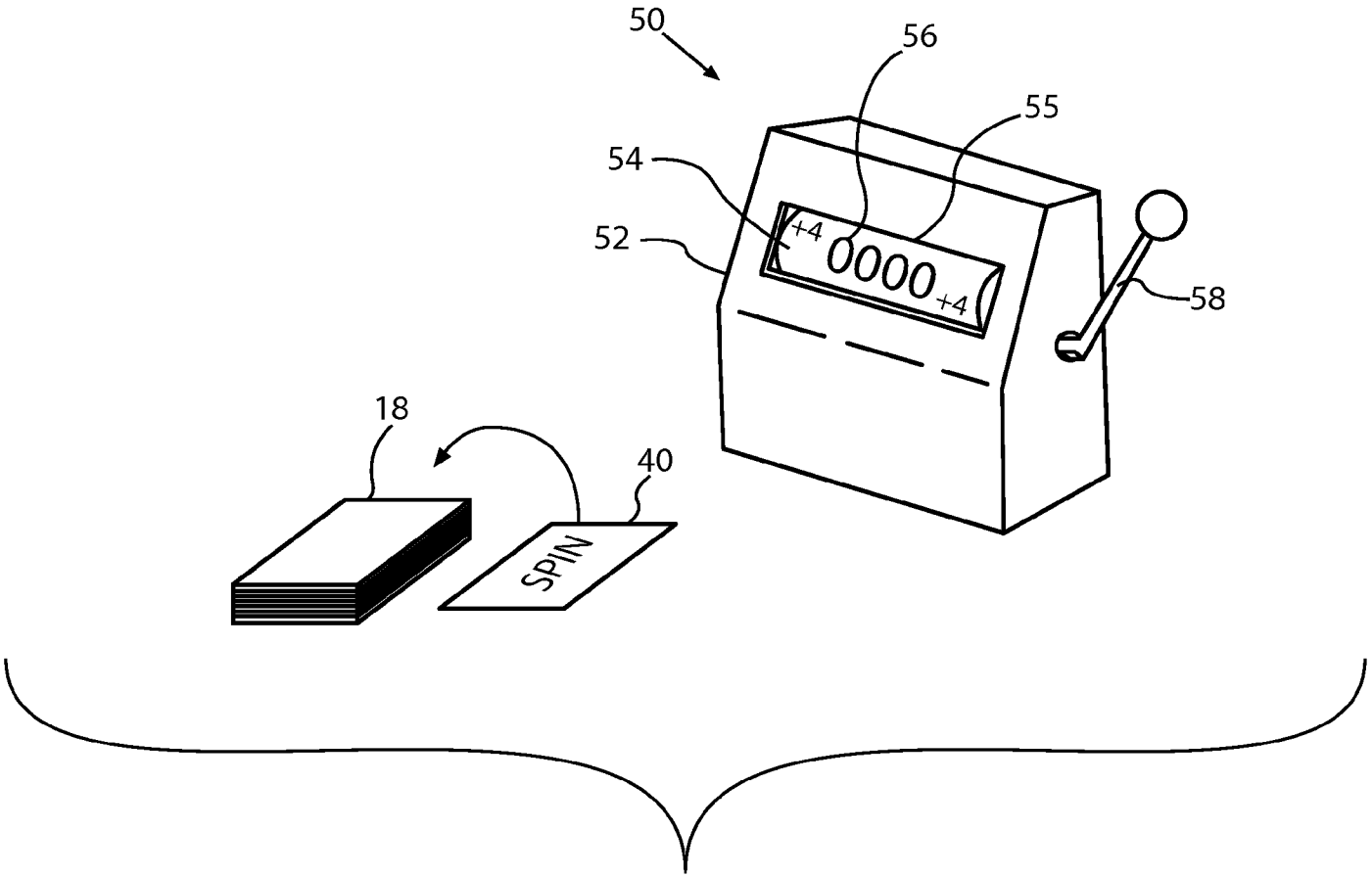
FIG. 2 is a perspective view of a game assembly containing a second exemplary embodiment of a random chance device.

The use of a spinning game board 12 is only one of many spinning wheel configurations that can be adapted for use as part of the present invention. Referring to FIG. 2, an alternate type of spinning wheel random chance device is shown. The deck of playing cards 18 remains the same as in the first embodiment and will be identified with the same reference number to avoid confusion. In FIG. 2, a spinning wheel random chance device 50 is shown in the form of a novelty slot machine 52. The novelty slot machine 52 has a spinning wheel in the form of a display drum 54. The display drum 54 spins in a vertical plane around a horizontal axis. Printed on the display drum 54 are indicia 56 corresponding to the various event cards that are in the deck of playing cards 18 or are provided as new event activities. An activator arm 58 is present on the novelty slot machine 52. When the activator arm 58 is pulled, the display drum 54 spins for a predetermined time. The display drum 54 spins behind a window 55 that acts as an indicator arrow. After several rotations, the display drum 54 stops spinning, wherein the window 55 displays a single indicia 56 that corresponds to one of the event cards in the deck of playing cards 18.

It will be understood that the shape of the novelty slot machine 52 is arbitrary, Furthermore, the size of the display drum 54 and the means to activate the novelty slot machine 52 can be changed as a matter of design choice.

A player activates the novelty slot machine 52 when that player selects a spin card 40 during play from the deck of playing cards 18. It will therefore be understood, that when a player selects a spin card 40 during play, it has the same effect as drawing an event card from the playing card deck 18. However, due to the nature of the spinning wheel random chance device 50, the selection of the event card is random. This second layer of randomness does not change the cards used during play, other than to add spin cards 40 to the playing card deck 18. Furthermore, the game is still played with its original rules in all respects aside from the use of the spinning wheel random chance device 50.

Figure 3:
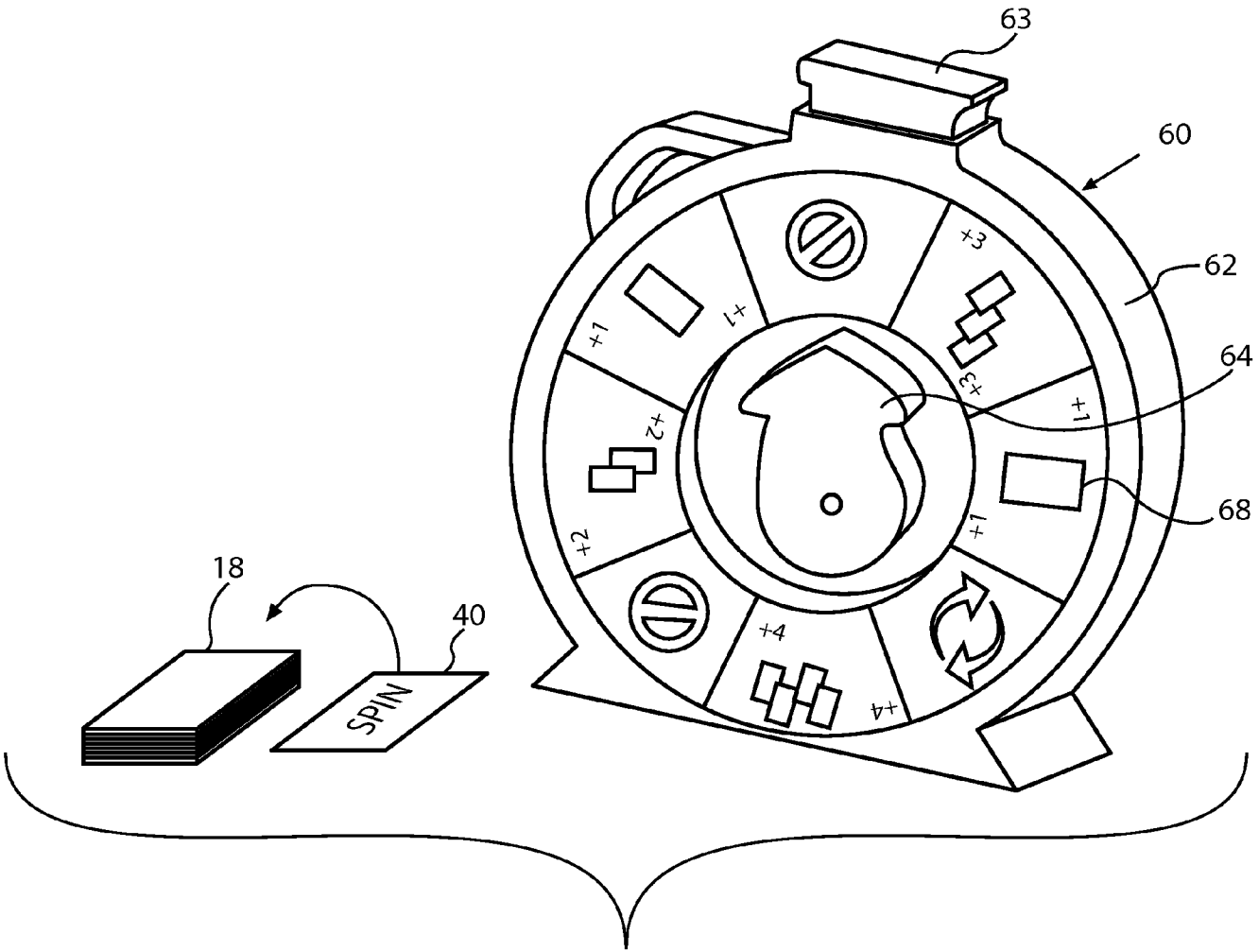
FIG. 3 is a perspective view of a game assembly containing a third exemplary embodiment of a random chance device.

Referring to FIG. 3, yet another embodiment of a spinning wheel random chance device 60 is shown. In FIG. 2, a random chance device 60 is shown in the form of a clock face selector 62. The clock face selector 62 has a central indicator arrow 64 that spins when the clock face selector 62 is activated. The indicator arrow 64, therefore, spins in a vertical plane around a vertical axis. The clock face selector 62 can be activated by pulling a string, moving a lever, or pushing an activation button 63, as is shown. Once activated, the central indicator arrow 64 spins and stops in a random position.

Surrounding the central indicator arrow 64 is an annular board 66 containing indicia 68. The indicia 68 correspond to the various event cards that are in the playing card deck 18 or some new even activity that is to be added to the game. Once the central indicator arrow 64 stops spinning, the central indicator arrow 64 randomly points to one of the indicia 68 on the annular board 66.

A player activates the clock face selector 62 when that player selects a spin card 40 during play from the deck of playing cards 18. It will therefore be understood, that when a player selects a spin card 40 during play, it has the same effect as drawing an event card from the deck of playing cards 18. However, due to the nature of the clock face selector 62, the selection of the event card is random. This second layer of randomness does not change the cards used during play, other than to add spin cards 40 to the deck of playing cards 18. Furthermore, the game is still played with its original rules in all respects aside from the use of the spinning wheel random chance device 10.

Figure 4:
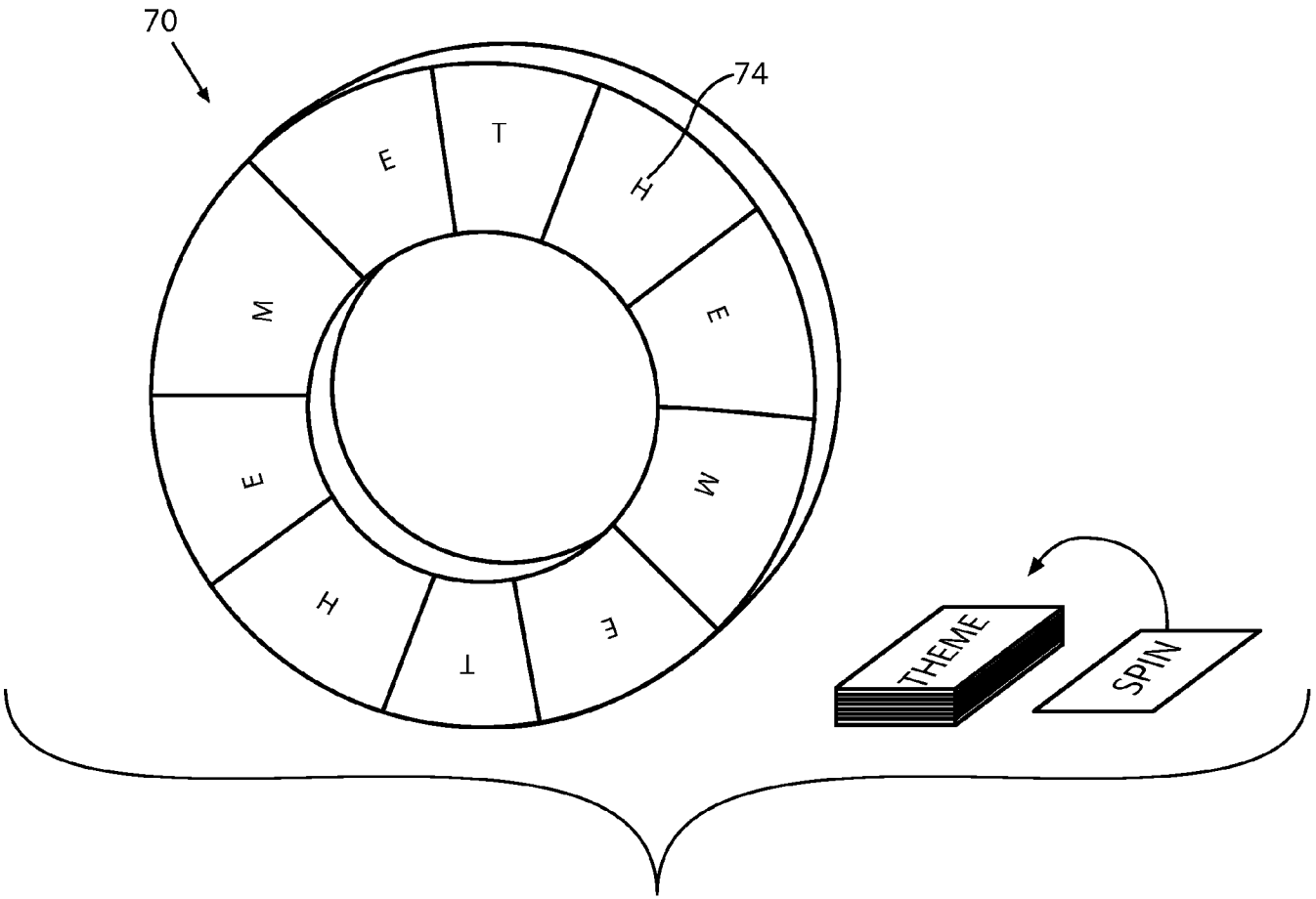
FIG. 4 is a perspective view of a theme change kit for a game assembly.

In the toy industry, there has been a growing trend to make special runs of toys that are themed to match a particular movie or television show that is popular. Referring to FIG. 4, it will be understood that by using a spinning wheel random chance device, theme kits 70 can be made available. A theme kit 70 would be comprised a new deck of playing cards 72 that has the new theme and a new wheel indicia 74 that corresponds to the themed cards in the new deck of playing cards 72. In the embodiment of FIG. 1, the new wheel indicia 74 would come in the form of an annular board that can be placed onto the spinning wheel random selection device 10 shown in FIG. 1 or the clock face selector 62 shown in FIG. 3. It will be understood that the new wheel indicia 74 would take the shape of a drum if used in the embodiment of FIG. 2.

As has been previously stated, many games utilize playing card decks that contain event cards. The present invention random selection device can be adapted for use in any such game. It will also be understood that the embodiments of the invention that are illustrated are exemplary and that a person skilled in the art can make many variations to the described invention using functionally equivalent components. For example, the use of a wheel that is manually spun can be replaced with a wheel that is electrically rotated. Furthermore, the use of a mechanical wheel can be replaced with a circular array of lights that can randomly be activated. All such variations, modifications and alternate embodiments are intended to be included within the scope of the present invention.

What is claimed is:

1. In a game having a deck of cards for selection during play, a method of adding additional randomness to the selection of cards from said deck of cards, said method comprising the steps of:

providing a deck of cards containing individual cards;

providing indicia corresponding to at least some of said cards in said deck of cards;

providing a selection device that randomly selects a single indicia, from said indicia;

providing at least one card that indicates that said selection device is to be used; and placing said at least one card into said deck of cards prior to play.

2. The method according to claim 1, wherein said step of providing a selection device includes providing a wheel and an arrow that have temporary relative motion, wherein said arrow randomly points to a section of said wheel after said temporary relative motion.

3. The method according to claim 2, wherein said step of providing indicia, includes providing indicia on said wheel, wherein said arrow points to one indicia from among said indicia after said temporary relative movement.

4. The method according to claim 2, wherein said wheel spins in a horizontal plane around a vertical axis.

5. The method according to claim 2, wherein said wheel spins in a vertical plane around a horizontal axis.

6. The method according to claim 1, wherein said deck of cards contains play cards and event cards, wherein said step of providing indicia corresponding to at least some of said cards, includes providing indicia corresponding to said event cards.

7. The method according to claim 3, further including the step of providing a receptacle for holding said deck of cards, wherein said receptacle and said wheel are interconnected.

8. A card game assembly, comprising:

a deck of cards containing event cards;

a spinning random selector having indicia corresponding to said event cards, wherein said spinning random selector randomly selects from said indicia a single indicia corresponding to one of said event cards when activated; and at least one activation card contained within said deck of cards that indicates that said spinning random selector is to be activated.

9. The assembly according to claim 8, wherein said indicia are selectively replaceable on said spinning random selector.

10. The assembly according to claim 8, wherein said spinning random selector includes a wheel that rotates relative a stationary arrow, wherein said indicia are present on said wheel.

11. The assembly according to claim 8, wherein said spinning random selector includes a stationary wheel and an arrow that moves relative said wheel, wherein said indicia are present on said wheel.

12. A game assembly, comprising:

a deck of cards;

a platform supporting at least one receptacle for receiving said deck of cards;

an annular disc that is free to rotate around said platform, said annular disc having a top surface segmented into a plurality of spaces;

indicia disposed within said plurality of spaces, wherein said indicia identify some cards contained within said deck of cards; and a stationary indicator that points to at least one of said spaces when said annular disc is at rest.

13. The assembly according to claim 12, further including posts extends from said annular disc.

14. The assembly according to claim 13, further including a stationary flap for slapping past said posts as said annular disc rotates.

15. The assembly according to claim 12, wherein said indicia are set on a removable façade that rests upon said annular disc.

16. The assembly according to claim 12, wherein said deck of cards includes at least one spin card that indicates that said annular disc should be rotated.

17. The assembly according to claim 12, wherein said deck of cards includes play cards and event cards, wherein said indicia on said spaces correspond to said event cards.

* * * * *